US007832664B2

(12) United States Patent
Albus

(10) Patent No.: US 7,832,664 B2
(45) Date of Patent: Nov. 16, 2010

(54) JET MILL

(76) Inventor: James F. Albus, 10 Crestview Dr., Fleetwood, PA (US) 19522

( * ) Notice: Subject to any disclaimer, the term of this patent is extended or adjusted under 35 U.S.C. 154(b) by 113 days.

(21) Appl. No.: 12/054,646

(22) Filed: Mar. 25, 2008

(65) Prior Publication Data

US 2009/0242672 A1 Oct. 1, 2009

(51) Int. Cl.
*B02C 19/06* (2006.01)

(52) U.S. Cl. ..... 241/5; 241/39

(58) Field of Classification Search ..... 241/5, 241/39

See application file for complete search history.

(56) References Cited

U.S. PATENT DOCUMENTS 2,237,091 A * 4/1941 Stephanoff ..... 241/5
2,590,220 A 3/1952 Stephanoff
3,508,714 A * 4/1970 Stephanoff ..... 241/39
3,648,936 A 3/1972 Stephanoff
3,675,858 A * 7/1972 Stephanoff ..... 241/5
3,877,647 A * 4/1975 Gorobets et al. ..... 241/39
4,198,004 A 4/1980 Albus et al.
4,592,302 A * 6/1986 Motoyama et al. ..... 118/303
4,824,030 A * 4/1989 Kano et al. ..... 241/39
4,875,629 A * 10/1989 Brors ..... 241/39

* cited by examiner

*Primary Examiner*—Faye Francis
(74) *Attorney, Agent, or Firm*—Howson & Howson LLP

(57) ABSTRACT

In a vertical loop jet mill, a grinding chamber in the lower part of the loop is trapezoidal in shape with side walls converging toward the outside of the loop. Removable nozzle plates are provided in the lower parts of the side walls of the grinding chamber, and the nozzles are directed so that gas streams from nozzles on one side intersect gas streams from nozzles on the other side. A removable insert, with trapezoidal end panels forms the upper wall of the grinding chamber.

16 Claims, 4 Drawing Sheets

Fig. 4
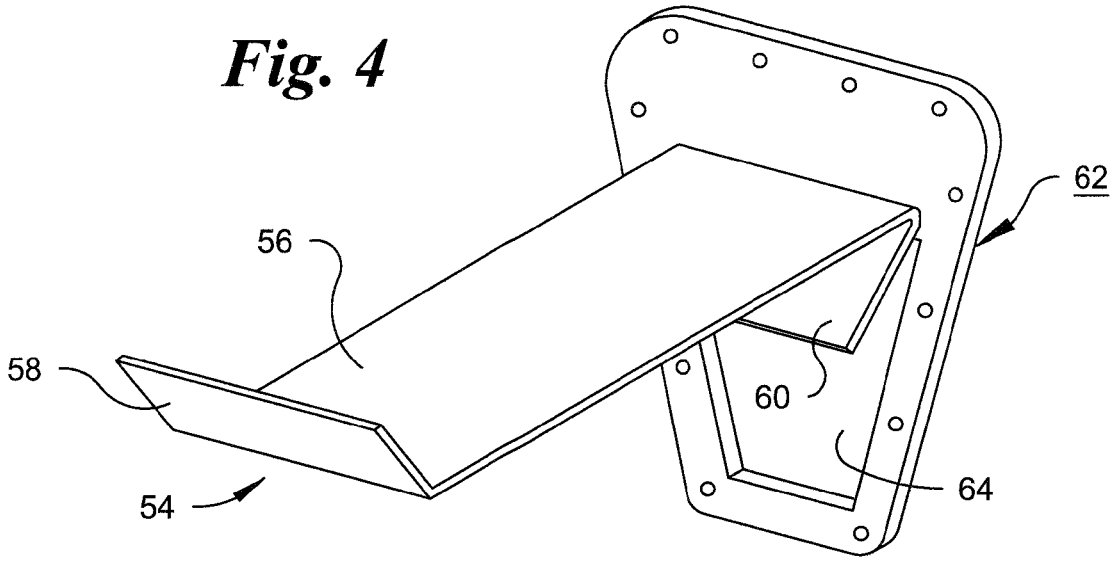
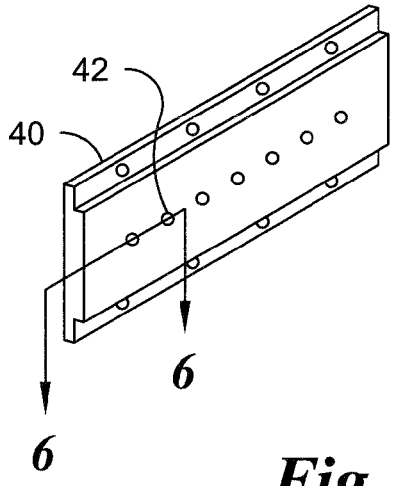
Fig. 5
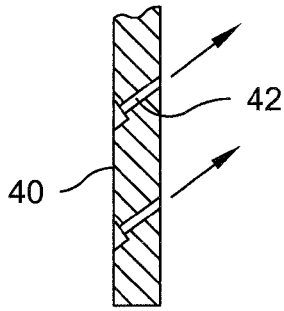
Fig. 6

JET MILL

FIELD OF THE INVENTION

This invention relates to jet mills, that is, apparatus in which the size of the particles of a solid particulate material is reduced by causing the particles to collide with one another while traveling at high velocity in a stream of gas, usually air or steam.

BACKGROUND OF THE INVENTION

Recirculating jet mills are widely used for effecting reduction of solid materials to extremely fine particle sizes. Most jet mills fall into one or the other of two general types: the horizontal, or "pancake," jet mill, and the loop-type jet mill, which is usually, but not necessarily, in the form of a vertical loop, and sometimes referred to as a "vertical" jet mill.

In the horizontal jet mill, raw material enters a hollow, circular, chamber where it comes into contact with high velocity jets of gas that enter the chamber through its periphery at angles such as to cause a circulating movement of gas and particles in the chamber. The jets of gas cause the particles to accelerate and collide with one another. The collisions result in a reduction in the sizes of the particles. The smaller particles exit the chamber through a central opening, while the larger particles continue to circulate until they are reduced by collision into smaller particles.

A typical loop jet mill comprises a conduit arranged to form a closed loop or toroid. Gas nozzles are provided in the periphery of the conduit for the introduction of streams of gas (usually air or steam) at high velocities. Gas and particles circulate within the conduit in a direction determined by the direction of the jets of gas that enter the conduit through the nozzles. Typically, the loop is somewhat elongated, and comprises a bottom section, which serves as a grinding chamber, and a curved upper section, which serves as a classifier. These sections are typically interconnected by conduit sections, referred to as "stacks". The gas nozzles are usually located in the grinding chamber, and are directed in such a way as to produce a circulating flow of gas in one direction around the loop. A material feed port precedes the grinding chamber in the direction of circulating flow, for feeding raw material into the gas stream circulating within the mill. The raw material is carried into the grinding chamber where it encounters the high velocity gas streams. These gas streams cause the particles to collide with one another to effect pulverization. The particles are then carried upward by the gas stream to the classifier section at the top of the mill. There, because of the curvature of the conduit and the inertia of the particles, the larger particles which are heavier, are concentrated toward the outer periphery of the classifier section. An outlet port is provided at or near the downstream end of the classifier section. The outlet port is open toward the inside of the loop, and fine particles are carried out through the outlet port with the gas stream. These particles are then separated from the gas stream by conventional separators such as cyclone separators, bag collectors, and the like. In the meanwhile, the heavier particles are returned to the grinding chamber, and continue to circulate in the mill until they are reduced to a sufficiently fine size to be carried out through the outlet port.

In some jet mills, classification of particles is aided by a dynamic classifier, which includes a rotor in the classifier section of the mill. The rotor effects centrifugal separation of the lighter small particles from the heavier large particles, causing the small particles to exit the mill while permitting the heavier particle to continue to circulate until they are reduced to small particles.

BRIEF SUMMARY OF THE INVENTION

The jet mill according to the invention comprises a conduit disposed in a loop, an inlet, a grinding chamber, a classifier and an outlet. The inlet is provided for entry of raw material into the loop. The grinding chamber is formed as part of the loop, and has multiple nozzles for flow of gas into the loop. The nozzles are directed obliquely into the grinding chamber to cause a circulating flow of a gas stream in a first direction through the loop. The classifier effects centrifugal separation of fine particles in the gas stream from larger particles in the gas stream. As in a conventional loop-type jet mill, the classifier can be a simple classifier constituted by a curved part of the loop, or a dynamic classifier. The outlet delivers the fine particles along with gas from the loop. The nozzles of the grinding chamber are composed of a first set of nozzles and a second set of nozzles, the first and second sets of nozzles being located on opposite sides of the grinding chamber. Each of these nozzles on one side of the grinding chamber is directed along a line that intersects a line along which a nozzle on the opposite side of the grinding chamber is directed, to enhance collision between the particles. The nozzles of each set are preferably, but not necessarily, arranged along a straight line.

Preferably, the grinding chamber is located at the bottom of the loop, and the distance between the bottom and the top of the grinding chamber is substantially constant along the direction of flow of gas and particles through the grinding chamber. The openings of the nozzles, through which gas jets enter the grinding chamber should be located at a distance from the bottom of the grinding chamber between approximately one tenth and one half the distance from the bottom to the top of the grinding chamber, and the distance from the bottom of the grinding chamber to the nozzle openings is preferably less than approximately one fourth the distance from the bottom to the top of the grinding chamber.

The grinding chamber preferably has a substantially trapezoidal interior cross section. Its top wall, which is the wall nearest the inner portion of the loop, is wider than its bottom wall, which is the wall nearest the outside of the loop. The grinding chamber is further defined by side walls that converge from the top wall toward the bottom wall. The nozzles are preferably constituted by openings in the side walls, and the side walls can be formed in part by removable plates, in which case the nozzles of the grinding chamber can be constituted by openings in the removable plates.

In a preferred embodiment, the top of the grinding chamber is constituted by a part of a removable insert, the part being in the form of a plate extending across the grinding chamber from one of the side walls of the grinding chamber to the other. The removable insert allows for modification of the cross sectional area of the grinding chamber.

The insert may also include a first panel, or baffle, extending obliquely from the upstream end of the plate toward the bottom wall of the grinding chamber and in the direction of flow, and a second panel, or baffle, extending obliquely in the direction of flow from the downstream end of the plate toward the inside wall of the loop.

The conduit portion in which the grinding chamber is located is preferably removable from the remainder of the conduit, allowing removal or insertion of the insert.

If the bottom portion of the conduit is trapezoidal in shape, the panels extending from the opposite ends of the plate may also be trapezoidal in shape, so that they extend obliquely downward and upward, respectively, from the upstream and downstream ends of the plate, with the side edges respectively converging and diverging away from the plate, with their side edges either meeting, or closely approaching, the side walls of the conduit.

The intersection of gas streams from opposed nozzles, and the location of the nozzles near the narrower outside portion of the trapezoidal grinding chamber, ensure that collision of particles occurs near the nozzle exits, where the greatest amount of kinetic energy can be imparted by the gas streams to the particles circulating through the grinding chamber. Thus, the invention can grind raw material more efficiently than conventional jet mills.

The trapezoidal shape of the grinding chamber also makes it simpler and easier to modify the nozzle size and configuration, to change the cross-sectional area of the grinding chamber, and to add other components, such as wear-resistant plates for handling abrasive materials and special plates for enhancing grinding of other substances such as urethane, PTFE, rubber, etc.

Removability of the nozzle plates and the insert that forms the top wall of the grinding chamber affords a high degree of flexibility, permitting the user to adjust the jet mill operating parameters, such as circulation velocity, grinding chamber size, the number and size of the nozzles, nozzle direction and nozzle jet velocity, etc.

Other objects, details and advantages of the invention will be apparent from the following detailed description when read in conjunction with the drawings.

BRIEF DESCRIPTION OF THE DRAWINGS

FIG. 4 is a perspective view of the insert;

FIG. 5 is a perspective view of a nozzle plate; and

FIG. 6 is a cross-sectional view of the nozzle plate, taken on section plane 6-6 in FIG. 5, and showing the direction of the nozzles.

DETAILED DESCRIPTION OF THE PREFERRED EMBODIMENT

Figure 1:
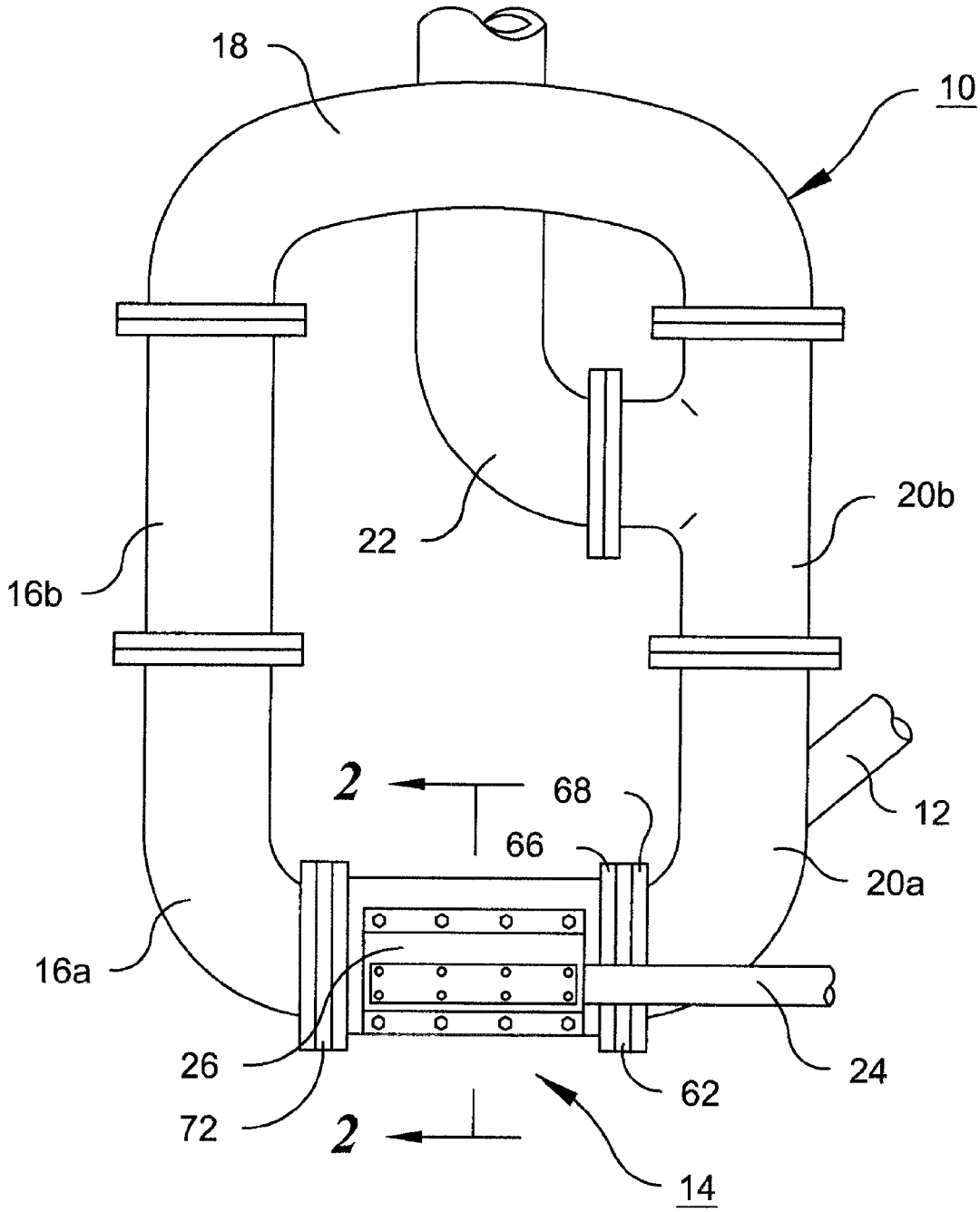
FIG. 1 is a front elevational view of a preferred jet mill according to the invention.

As shown in FIG. 1, the principal part of the jet mill 10 is a conduit disposed in a toroidal, i.e., loop-shaped, configuration. A raw feed inlet 12 is provided for feeding raw material into the mill conduit. Gas and particles flow clockwise in the mill as shown in FIG. 1. A grinding chamber section 14 is provided in the lower part of the loop, and is connected to the upright parts of the loop by flanges.

A curved transition section 16*a* follows the grinding chamber in the direction of flow, and connects the grinding chamber to a vertical stack 16*b*, which is, in turn, connected to a classifier section 18 at the top of the loop. The other end of the classifier section is connected to a vertical 20*b*, through which gas and particles flow downward and return to the grinding chamber 14 through a curved transition section 20*a*. An outlet passage 22 is provided on the inner wall of the loop near the top of stack 20*b*, for discharge of gas and small particles which are separated from the larger particles in the classifier section 18. The classifier section can be constituted simply by a curved section of the conduit as shown. As mentioned previously, as an alternative, a dynamic classifier (not shown) can be incorporated into the mill.

Figure 2:
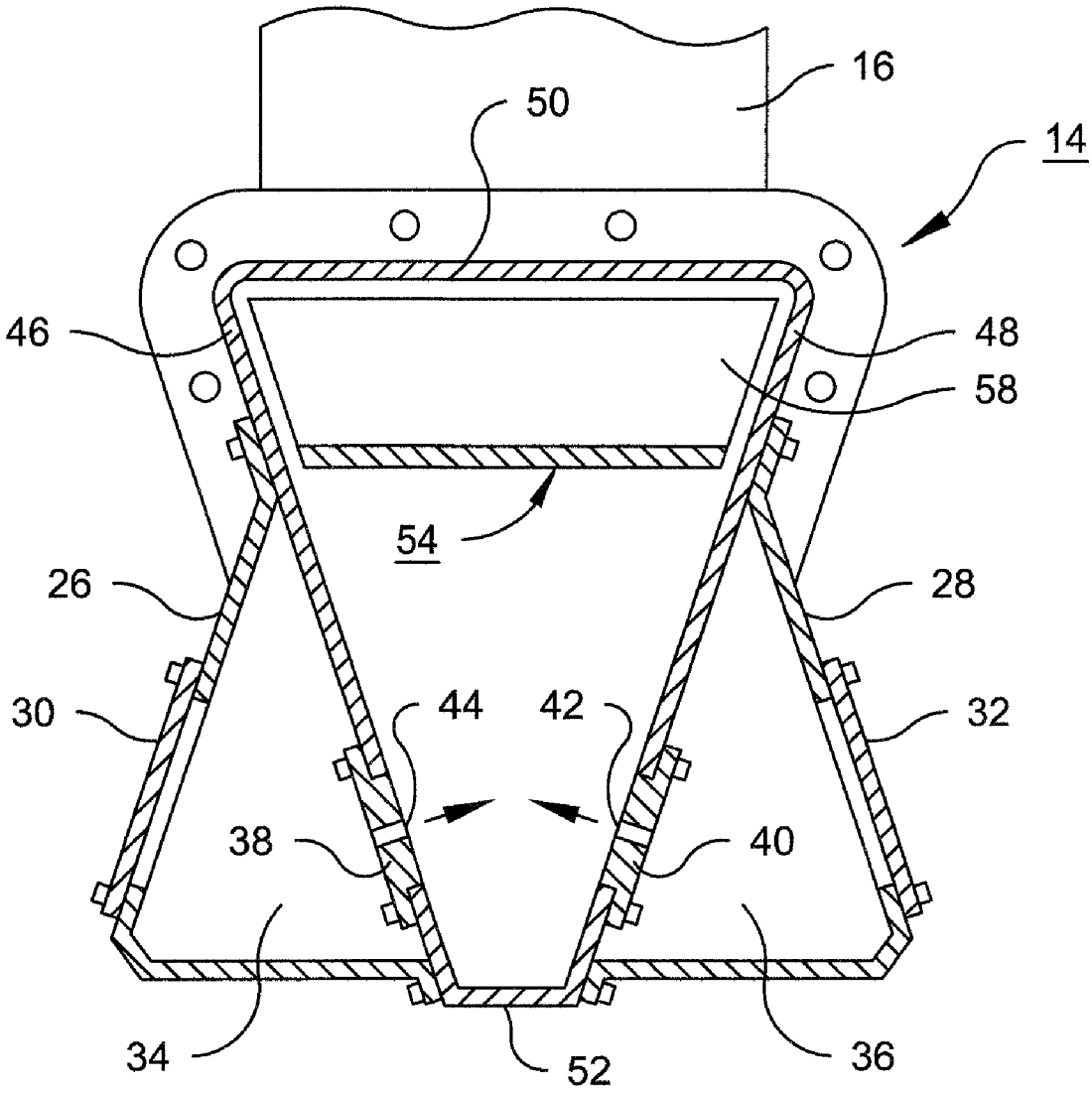
FIG. 2 is a cross-sectional view of the grinding chamber of the jet mill, taken on section plane 2-2 in FIG. 1.

Gas, such as air or superheated steam, is fed under high pressure through a pipe 24 into a manifold 26 on one side of the grinding chamber. A similar pipe, not shown, feeds gas under high pressure into a manifold 28 (FIG. 2) on the opposite side of the grinding chamber. As shown in FIG. 2, the manifolds 26 and 28 have access panels 30 and 32, respectively.

Pressurized gas in the interior spaces 34 and 36 of the manifolds passes through nozzles formed in plates 38 and 40, which are removably fitted to rectangular openings formed in walls of the grinding chamber 14. Two such nozzles, 42 and 44, are shown in FIG. 2.

As seen in FIG. 2, the grinding chamber 14 is trapezoidal in shape, and constituted by a part of a trapezoidal conduit section having opposed side walls 46 and 48, which converge downward from a wide upper wall 50 to a relatively narrow lower wall 52. The width of the upper wall 50 is preferably about four times the width of the lower wall 52.

Nozzle plate 38 is a flanged, elongated, rectangular plate, that fits into a rectangular opening in the lower part of side wall 46, and plate 40, which is similar to plate 38, fits into a rectangular opening in the lower part of side wall 48. Both plates are elongated along the direction of flow, and preferably have a series of nozzles, as shown in FIG. 5, the nozzles being aligned along the plate in parallel relation to the direction of elongation of the plate. Preferably, the parts of plates 38 and 40 between the flanges are sized to fit the rectangular openings in the side walls of the grinding chamber, and the thickness of those parts is such that, when installed, the plates are flush with the inner faces of side walls 46 and 48.

The nozzles are oblique as shown in FIG. 6, and therefore direct jets of gas into the grinding chamber obliquely toward the stream of gas and particles circulating through the mill, in the directions indicated by the arrows in FIGS. 2 and 6.

Preferably, the direction of flow through each nozzle on one side of the grinding chamber intersects the direction of flow through a nozzle on the opposite side of the grinding chamber. Moreover, the nozzles are positioned in the lower part of the grinding chamber, where the nozzles on opposite sides of the grinding chamber are relatively close together. The nozzles of the grinding chamber open to the grinding chamber at a vertical distance from the bottom of the grinding chamber equal to about one fourth the vertical distance from the bottom wall 52 to the top of the grinding chamber, which is defined by in insert 54. Although the heights of the nozzle openings are preferably not more than approximately one-fourth the height of the grinding chamber, the nozzle openings can be located above the bottom of the grinding chamber by a distance between approximately one tenth and one half the distance between the bottom and the top of the grinding chamber.

Figure 3:
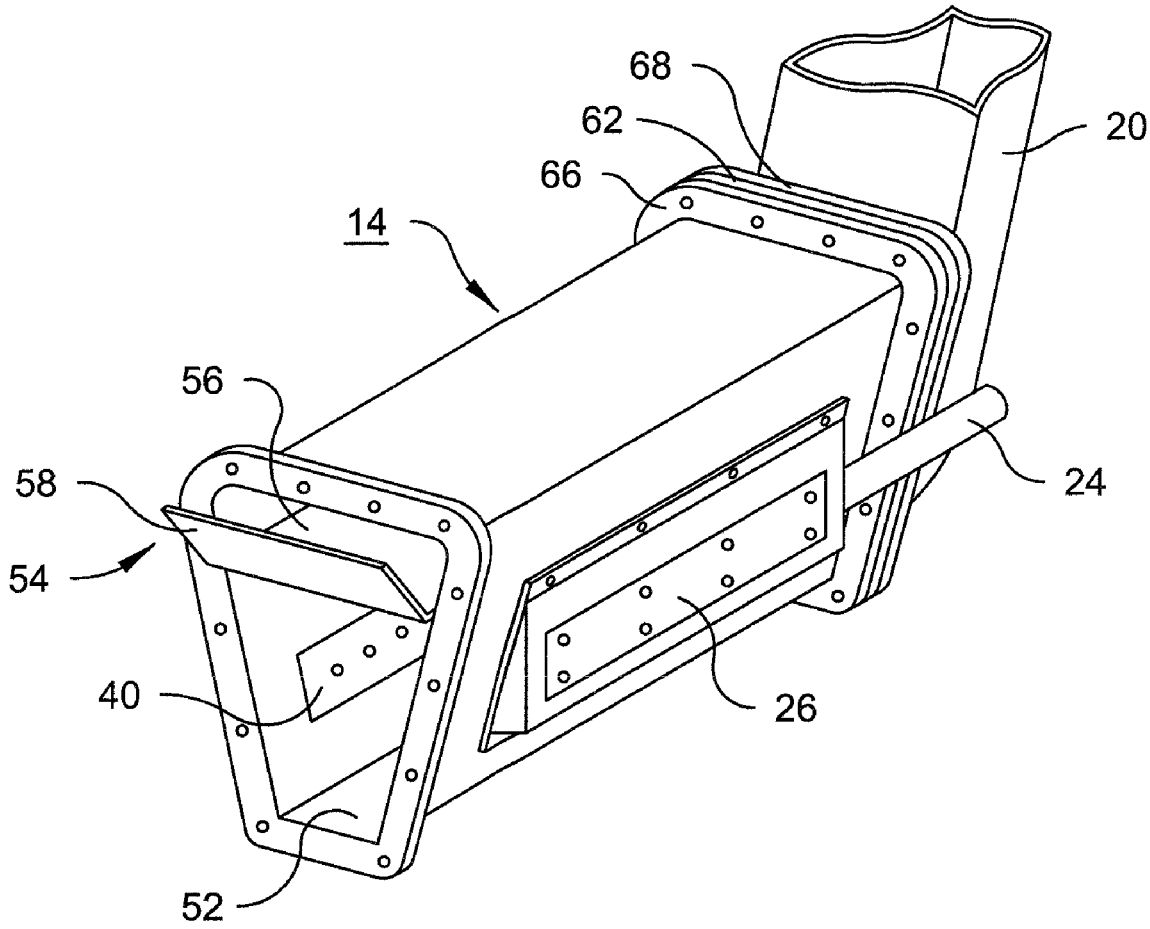
FIG. 3 is a perspective view of the grinding chamber of the jet mill of FIG. 1, showing the removable grinding chamber top wall-defining insert.

The insert 54, which defines the top of the grinding chamber, i.e., the side nearest the inside of the loop, is preferably a sheet of metal shaped, as shown in FIG. 4, so that it includes a substantially flat, elongated, rectangular plate 56, a panel 58 extending obliquely upward and in the direction of flow from the downstream end of the plate 56, and another panel 60, which extends obliquely downward and in the direction of flow from the upstream end of plate 56. The upstream end of plate 56 is welded to a trapezoidal plate 62, which has a trapezoidal opening 64 below the location of the weld. As shown in FIGS. 1 and 3, the plate 62 is clamped between an end flange 66 of the grinding chamber section and a flange 68 on the transition section 20*a*. The clamping of plate 62 between flanges provides support for the insert 54, although some additional support can be afforded by engagement of the edges of panel 58 with the side walls of the conduit. In order to take advantage of this additional support, the panel 58 should have a trapezoidal shape, with its edges positioned to engage the side walls of the conduit when it is installed. The plate 56 can also be supported by engagement of its longitudinal edges with side walls 46 and 48 of the grinding chamber conduit section. An optional trapezoidal spacer 72 can be provided between the flanges at the downstream end of the grinding chamber.

The trapezoidal conduit of the grinding chamber can be opened by removal from the transition sections 16*a* and 20*a*, or by removal of the transition section 20*a* from the grinding chamber and stack 20*b*. The assembly consisting of plate 62 and insert 54 can be removed and replaced by a similar assembly, which can be identical to the original assembly, or which can have an insert located at a different height. In this way, the size of the grinding chamber can be adjusted. The oblique portions 58 and 60 are preferably trapezoidal in shape, and formed so that their side edges conform to the inner faces of side walls 46 and 48.

The length of the grinding chamber is defined by the length of the plate 56 of the insert, and the height of the grinding chamber is defined by the distance between plate 56 of the insert and the bottom wall 52. Thus, the grinding chamber has a substantially constant height throughout its length, and the height can be adjusted by replacement of the insert by another insert having a similar shape but different dimensions, e.g., a narrower rectangular portion and a higher trapezoidal end panel 58, or a wider rectangular portion and a shorter trapezoidal end panel 58.

The upstream end panel 60 serves as a diverting baffle, directing circulating gas and particles to the vicinity of the jets near the bottom of the grinding chamber. The upper part of plate 62 prevents gas and particles from flowing into the space above plate 56. End panel 58 also prevents accumulation of particles in the space above the plate 54.

The nozzle openings, i.e., the openings through which gas is ejected into the grinding chamber, should be located between about 1/10 and 1/2 the distance from the lower wall 52 and the flat, rectangular portion of the insert, and preferably within the lower 1/4 of the distance from the lower wall 52 and the flat, rectangular portion of the insert. The location of the nozzle openings, their opposed relationship, and the trapezoidal configuration of the grinding chamber, ensure that maximum energy is imparted by the gas jets to the particles circulating through the grinding chamber for efficient size reduction.

The nozzle plates can be readily replaced through the access openings in the manifolds, and nozzle plates can also be readily replaced by other nozzle plates having different nozzle configurations. In addition, by providing multiple assemblies, each consisting of a plate corresponding to plate 62 and an insert corresponding to insert 54, but having different plate heights, the height and cross-sectional area of the grinding chamber can be adjusted easily by replacement of the insert assembly.

Various modifications can be made to the mill shown and described. For example, the number and size of the nozzles in each nozzle plate can be selected depending on the volume of gas flow, which can vary through a wide range, e.g., from less than 50 cfm to more than 1500 cfm of air, depending on the mill size and its application. The angle at which the nozzles are directed can also vary, but is typically in the range from 30 to 70 degrees relative to an imaginary line perpendicular to the face of the nozzle plate. Although the nozzle openings are preferably arranged in a single straight line parallel to the direction of flow through the grinding chamber, other configurations can be adopted, including plural lines of nozzles.

Although the cross-sectional shape of the conduit section in which the grinding chamber is located is generally trapezoidal, transformer sections (not shown) can be provided to connect the trapezoidal conduit section to the stacks, in which case, the stacks and the classifier can have a circular cross-section or other cross-sectional shapes.

The preferred grinding chamber conduit section is a straight trapezoidal conduit. However, it is possible to utilize a curved conduit section for the grinding chamber.

In another modification, the horizontal plate that serves as a top wall of the grinding chamber can be welded to a plate clamped between flanges at the downstream end of the grinding chamber. In this case, it is desirable to form the oblique diverter panel on the upstream end of the horizontal plate so that it extends both obliquely downward toward the bottom of the grinding chamber and obliquely upward to the top of the conduit in which the grinding chamber is located.

Still other modifications may be made to the apparatus and method described above without departing from the scope of the invention as defined in the following claims.

I claim:

1. A jet mill comprising:

a conduit disposed in a substantially vertical loop;

an inlet for entry of raw material into the loop;

a grinding chamber formed as part of the loop, the grinding chamber being located at the bottom of the loop and having a bottom, a top, and two opposed side walls extending from the bottom to the top of the grinding chamber, the grinding chamber also having plural nozzles, connected to a source of gas outside the loop, for flow of gas from said source, through the nozzles, into the loop, the nozzles being directed obliquely into the grinding chamber to cause a circulating flow of a gas stream in a predetermined direction through the loop;

a classifier for centrifugal separation of fine particles in the gas stream from larger particles in the gas stream, the classifier being spaced, along said predetermined direction, downstream from the grinding chamber; and an outlet for delivery of fine particles along with gas from the loop;

wherein said nozzles of said grinding chamber are composed of a first set of nozzles constituted by openings in one of said side walls and a second set of nozzles constituted by openings in the other of said side walls, whereby the first and second sets of nozzles are located respectively on opposite sides of the grinding chamber, said opposite sides being respectively left and right sides with reference to the direction of flow of said gas stream through the grinding chamber, each said nozzle being directed obliquely in relation to the direction of flow of the gas stream in the grinding chamber, and each said nozzle on one side of the grinding chamber being directed along a line that intersects obliquely a line along which a nozzle on the opposite side of the grinding chamber is directed.

2. A jet mill according to claim 1, in which the distance from the bottom to the top of the grinding chamber is substantially constant along the direction of flow of gas and particles through the grinding chamber, in which the openings of said nozzles, through which gas jets enter the grinding chamber, are located at a distance from the bottom of the grinding chamber between approximately one tenth and one half of said distance from the bottom to the top of the grinding chamber.

3. A jet mill according to claim 1, in which the distance from the bottom to the top of the grinding chamber is substantially constant along the direction of flow of gas and particles through the grinding chamber, in which the openings of said nozzles, through which gas jets enter the grinding chamber are located at a distance from the bottom of the grinding chamber not more than approximately one fourth of said distance between the bottom and the top of the grinding chamber.

4. A jet mill according to claim 1, in which said grinding chamber has a substantially trapezoidal shape, said top of the grinding chamber being wider than the bottom of the grinding chamber.

5. A jet mill according to claim 1, in which said grinding chamber has a substantially trapezoidal shape, said top of the grinding chamber being wider than the bottom of the grinding chamber, and in which the side walls of the grinding chamber converge from the top of the grinding chamber toward the bottom of the grinding chamber.

6. A jet mill comprising:

a conduit disposed in a loop;

an inlet for entry of raw material into the loop;

a grinding chamber formed as part of the loop, the grinding chamber having plural nozzles for flow of gas into the loop, the nozzles being directed obliquely into the grinding chamber to cause a circulating flow of a gas stream in a predetermined direction through the loop;

a classifier formed for centrifugal separation of fine particles in the gas stream from larger particles in the gas stream; and an outlet for delivery of fine particles along with gas from the loop;

wherein said nozzles of said grinding chamber are composed of a first set of nozzles and a second set of nozzles, the first and second sets of nozzles being located on opposite sides of the grinding chamber and each said nozzle on one side of the grinding chamber being directed along a line that intersects a line along which a nozzle on the opposite side of the grinding chamber is directed; and wherein said grinding chamber is located at the bottom of the loop and has a bottom and a top, and a substantially trapezoidal shape, said top of the grinding chamber being wider than the bottom of the grinding chamber, in which the grinding chamber has side walls that converge from the top of the grinding chamber toward the bottom of the grinding chamber, in which said side walls are formed in part by removable plates, and in which said nozzles of the grinding chamber are constituted by openings in said removable plates.

7. A jet mill comprising:

a conduit disposed in a loop;

an inlet for entry of raw material into the loop;

a grinding chamber formed as part of the loop, the grinding chamber having plural nozzles for flow of gas into the loop, the nozzles being directed obliquely into the grinding chamber to cause a circulating flow of a gas stream in a predetermined direction through the loop;

a classifier formed for centrifugal separation of fine particles in the gas stream from larger particles in the gas stream; and an outlet for delivery of fine particles along with gas from the loop;

wherein said nozzles of said grinding chamber are composed of a first set of nozzles and a second set of nozzles, the first and second sets of nozzles being located on opposite sides of the grinding chamber and each said nozzle on one side of the grinding chamber being directed along a line that intersects a line along which a nozzle on the opposite side of the grinding chamber is directed; and wherein said grinding chamber is located at the bottom of the loop and has a bottom and a top, and a substantially trapezoidal shape, in which the grinding chamber has side walls that converge from the top of the grinding chamber toward the bottom of the grinding chamber, in which said top of the grinding chamber is wider than the bottom of the grinding chamber and constituted by a part of a removable insert, said part of the removable insert being in the form of a plate extending across the grinding chamber from one of said side walls to the other.

8. A jet mill comprising:

a conduit disposed in a loop;

an inlet for entry of raw material into the loop;

a grinding chamber formed as part of the loop, the grinding chamber having plural nozzles for flow of gas into the loop, the nozzles being directed obliquely into the grinding chamber to cause a circulating flow of a gas stream in a predetermined direction through the loop;

a classifier formed for centrifugal separation of fine particles in the gas stream from larger particles in the gas stream; and an outlet for delivery of fine particles along with gas from the loop;

wherein said nozzles of said grinding chamber are composed of a first set of nozzles and a second set of nozzles, the first and second sets of nozzles being located on opposite sides of the grinding chamber and each said nozzle on one side of the grinding chamber being directed along a line that intersects a line along which a nozzle on the opposite side of the grinding chamber is directed; and wherein said conduit includes a conduit portion forming the bottom of the loop, in which the grinding chamber is located within said conduit portion at the bottom of the loop and has a bottom and a top, and a substantially trapezoidal shape, in which the grinding chamber has side walls that converge from the top of the grinding chamber toward the bottom of the grinding chamber, in which said top of the grinding chamber is wider than the bottom of the grinding chamber and constituted by a part of an insert, said part of the insert being in the form of a plate extending across the grinding chamber from one of said side walls to the other, said part of the insert being substantially rectangular and having a first end and a second end spaced downstream from the first end along the direction of flow of said gas stream through the loop, and said insert also including a panel extending from said first end toward the bottom of said conduit portion forming the bottom of the loop.

9. A jet mill according to claim 8 in which said conduit portion forming the bottom of the loop is removable from the remainder of the conduit, allowing removal or insertion of said insert.

10. A jet mill according to claim 8 in which said conduit portion is trapezoidal in shape, and in which said panel of the insert is also trapezoidal in shape, and extends obliquely upward and upstream from an edge of said plate substantially to the top of said conduit portion, said panel having side edges diverging away from said plate and substantially meeting side walls of said conduit portion.

11. A jet mill according to claim 10 in which said conduit portion forming the bottom of the loop is removable from the remainder of the conduit, allowing removal or insertion of said insert.

12. A jet mill according to claim 8, in which said insert also includes a second panel extending from said second end toward the top of said conduit portion forming the bottom of the loop.

13. A jet mill according to claim 12 in which said conduit portion forming the bottom of the loop is removable from the remainder of the conduit, allowing removal or insertion of said insert.

14. A jet mill according to claim 12 in which said conduit portion is trapezoidal in shape, and in which each of said first and second panels of the insert is also trapezoidal in shape, in which the first panel extends obliquely downward from an edge of said plate substantially to the bottom of said conduit portion and has side edges converging away from the plate, and the second panel extends obliquely upward from an edge of the plate and has side edges diverging away from said plate, said side edges of the first and second panels substantially meeting side walls of said conduit portion.

15. A jet mill according to claim 14 in which said conduit portion forming the bottom of the loop is removable from the remainder of the conduit, allowing removal or insertion of said insert.

16. A jet mill according to comprising:

a conduit disposed in a loop;

an inlet for entry of raw material into the loop;

a grinding chamber formed as part of the loop, the grinding chamber having plural nozzles for flow of gas into the loop, the nozzles being directed obliquely into the grinding chamber to cause a circulating flow of a gas stream in a predetermined direction through the loop;

a classifier formed for centrifugal separation of fine particles in the gas stream from larger particles in the gas stream; and an outlet for delivery of fine particles along with gas from the loop;

wherein said nozzles of said grinding chamber are composed of a first set of nozzles and a second set of nozzles, the first and second sets of nozzles being located on opposite sides of the grinding chamber and each said nozzle on one side of the grinding chamber being directed along a line that intersects a line along which a nozzle on the opposite side of the grinding chamber is directed; and wherein said conduit includes a conduit portion forming the bottom of the loop, said conduit portion having a flange at least at one end thereof said flange being connected in facing relationship to a second flange on an adjacent portion of the conduit, whereby said conduit portions are connected to each other, in which the grinding chamber is located within said conduit portion at the bottom of the loop and has a bottom and a top, and a substantially trapezoidal shape, in which the grinding chamber has side walls that converge from the top of the grinding chamber toward the bottom of the grinding chamber, in which said top of the grinding chamber is wider than the bottom of the grinding chamber and constituted by a first plate extending across the grinding chamber from one of said side walls to the other, said first plate having a first end and a second end spaced downstream from the first end along the direction of flow of said gas stream through the loop, and said jet mill also including a second plate located and held between said first and second flange, said second plate having an opening for flow of gas from one of said conduit portions to the other, the first plate being rigidly connected to, and supported at least in part by, said second plate.

* * * * *